US009413122B2

(12) United States Patent
Wu et al.

(10) Patent No.: US 9,413,122 B2
(45) Date of Patent: Aug. 9, 2016

(54) MODULAR JACK HAVING MIDDLE METAL PLATE SHIELDING TWO ADJACENT PORTS

(71) Applicant: FOXCONN INTERCONNECT TECHNOLOGY LIMITED, Grand Cayman (KY)

(72) Inventors: Jin-Han Wu, Kunshan (CN); Chih-Ching Hsu, New Taipei (TW); Jun-Hua Hu, Kun Shan (CN); Huan Chen, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/583,823

(22) Filed: Dec. 29, 2014

(65) Prior Publication Data

US 2015/0188263 A1 Jul. 2, 2015

(30) Foreign Application Priority Data

Dec. 30, 2013 (CN) ..... 2013 2 0879281
Dec. 30, 2013 (CN) ..... 2013 2 0879287
Dec. 30, 2013 (CN) ..... 2013 2 0879288
Dec. 30, 2013 (CN) ..... 2013 2 0879432

(51) Int. Cl.
*H01R 24/64* (2011.01)
*H01R 13/6587* (2011.01)
*H01R 107/00* (2006.01)

(52) U.S. Cl.
CPC ..... *H01R 24/64* (2013.01); *H01R 13/6587* (2013.01); *H01R 2107/00* (2013.01)

(58) Field of Classification Search
USPC ..... 439/607.25, 607.05, 607.55, 607.53, 439/620.18, 620.21, 676, 660
See application file for complete search history.

(56) References Cited

U.S. PATENT DOCUMENTS 4,799,901 A * 1/1989 Pirc ..... 439/620.15
5,069,641 A * 12/1991 Sakamoto et al. ..... 439/620.22
5,759,067 A * 6/1998 Scheer ..... 439/607.26
6,511,348 B1 * 1/2003 Wojtacki et al. ..... 439/620.18
6,537,110 B1 * 3/2003 Korsunsky et al. ..... 439/676
6,572,411 B1 * 6/2003 Aeschbacher et al. ... 439/620.21
6,736,680 B2 * 5/2004 Slack et al. ..... 439/676
6,786,772 B1 * 9/2004 Liu ..... 439/620.06
6,848,943 B2 * 2/2005 Machado et al. ..... 439/607.01
7,241,181 B2 * 7/2007 Machado et al. ..... 439/676

(Continued)

FOREIGN PATENT DOCUMENTS

CN 103001071 A1 3/2013

*Primary Examiner* — Alexander Gilman

(74) *Attorney, Agent, or Firm* — Wei Te Chung; Ming Chieh Chang

(57) ABSTRACT

A modular jack has an insulative housing, two adjacent internal modules, and a middle shield disposed between the adjacent internal modules. The insulative housing has a front wall and a plurality of openings therein configured as pairs of first and second aligned openings, and a receptacle located behind the openings. Each opening is configured to receive a plug connector therein in a front-to-back direction. The middle shield extends towards a front wall of the insulative to define two module receiving cavities each receiving one internal module. The middle shield includes a conductive plate and an insulative sheet affixed thereto. The insulative sheet faces to the internal modules for insulation between the internal modules and the conductive plate. The insulative sheet is very thin that it occupies little space of the receptacle, thereby reducing a size of the modular jack.

16 Claims, 7 Drawing Sheets

(56) References Cited

U.S. PATENT DOCUMENTS

| | | | | |
|---|---|---|---|---|
| 7,470,150 | B2 * | 12/2008 | Kuo et al. | 439/607.41 |
| 8,007,318 | B1 * | 8/2011 | Dunwoody et al. | 439/607.55 |
| 8,337,246 | B2 * | 12/2012 | Zhang | 439/607.01 |
| 8,339,806 | B2 * | 12/2012 | Cheng et al. | 361/816 |
| 8,449,332 | B2 * | 5/2013 | Purkis et al. | 439/620.18 |
| 8,636,540 | B2 * | 1/2014 | Bu | 439/490 |
| 8,992,248 | B2 * | 3/2015 | O'Malley et al. | 439/541.5 |
| 9,172,189 | B2 * | 10/2015 | Gao et al. | |
| 2005/0255746 | A1 * | 11/2005 | Hyland | 439/541.5 |
| 2009/0253293 | A1 * | 10/2009 | Zhang | 439/541.5 |
| 2010/0124842 | A1 * | 5/2010 | Bu et al. | 439/541.5 |
| 2012/0176756 | A1 * | 7/2012 | Gailus et al. | 361/752 |
| 2013/0130561 | A1 * | 5/2013 | Regnier | 439/701 |
| 2013/0288526 | A1 * | 10/2013 | Rascon et al. | 439/607.35 |
| 2014/0213100 | A1 * | 7/2014 | Xuan et al. | 439/490 |

* cited by examiner

MODULAR JACK HAVING MIDDLE METAL PLATE SHIELDING TWO ADJACENT PORTS

BACKGROUND OF THE INVENTION

1. Field of the Invention

The present invention relates to a modular jack having a middle metal plate disposed between two adjacent internal modules, and more particularly to insulate the middle metal plate with the internal modules.

2. Description of Related Art

One known modular jack comprises an insulative housing having a row of front openings each configured to receive a modular plug and a receptacle located behind the openings, a plurality of internal modules each inserted from the receptacle into one corresponding opening, and a plurality of middle shields each disposed between two adjacent internal modules. The internal module includes a plurality of mating contacts, a plurality of mounting contacts for mounting on an exterior mother board, and a horizontal printed circuit board (PCB) having a front section connecting with mating contacts and a rear section connecting with the mounting contacts. The PCB has a plurality of conductive filtering components such as transformers and common mode chokes mounted thereon. The internal shield has an insulative carrier and a metal plate insert molded in the insulative carrier. The insulative carrier isolates the metal plate from the filtering components. The insulative carrier is thick and thus occupies much space of the receptacle, resulting in the size of the modular jack being large. Furthermore, insert molding the metal plate with the insulative carrier adds cost.

Chinese Patent Application Publication No. CN103001071A, issued on Mar. 27, 2013, discloses a modular jack for transmitting 10 Gbit/s ethernet signals. The modular jack includes an insulative housing having two adjacent openings and a middle shield disposed between the openings, and a plurality of internal modules each corresponding to one of the openings. The middle shield is made of a metal plate. The metal plate and the conductive components of the internal module may undesirably cause shorting under high voltage transmission from a modular plug.

Hence, a modular jack having a simple and safe structure is desired.

SUMMARY OF THE INVENTION

Accordingly, an object of the present invention is to provide a modular jack having an insulative housing, two adjacent internal modules, and a middle shield disposed between the adjacent internal modules. The insulative housing has a front wall and a plurality of openings therein configured as pairs of first and second aligned openings, and a receptacle located behind the openings. Each opening is configured to receive a plug connector therein in a front-to-back direction. The middle shield extends towards a front wall of the insulative to define two module receiving cavities each receiving one internal module. The middle shield includes a conductive plate and an insulative sheet affixed thereto. The insulative sheet faces to the internal modules for insulation the internal modules and the conductive plate. The insulative sheet is so thin as to occupy only a little space of the receptacle, thus reducing a size of the modular jack. The cost of the affixed insulative sheet is also lower than the insert molding part.

Other objects, advantages and novel features of the invention will become more apparent from the following detailed description when taken in conjunction with the accompanying drawings.

DETAILED DESCRIPTION OF THE PREFERRED EMBODIMENT

Figure 1:
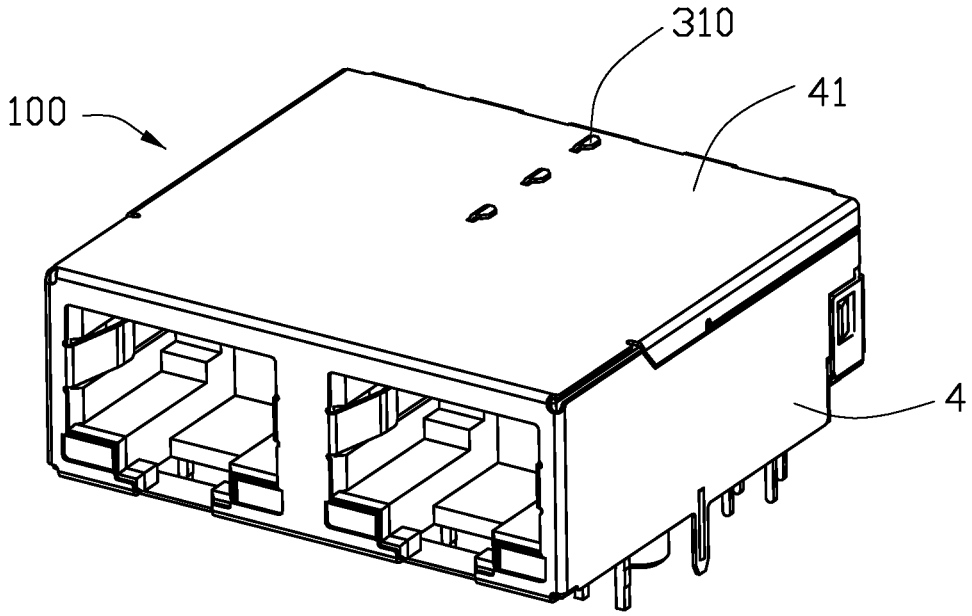
FIG. 1 is a perspective view of a modular jack according to the present invention.

Reference will now be made in detail to the preferred embodiment of the present invention.

Referring to FIGS. 1-5, a modular jack 100 according to the present invention is shown. The modular jack 100 could be mounted on a horizontal mother PCB (not shown). The modular jack 100 includes an insulative housing 1, two internal modules 21 and 22, a middle shield 3, four indicators 5, and a metal shell 4 enclosing the insulative housing 1 and the internal modules 21, 22.

The insulative housing 1 has a front wall 11, a top wall 13, a bottom wall 14, two opposite side walls 19, and a middle wall 12 located between the side walls 19. The bottom wall 14 extends backwardly beyond the middle wall 12. The top wall 13 extends backwardly from the front wall 11 and is terminated around the middle wall 12. Each side wall 19 has a top section terminated around the middle wall 12 and a bottom section extending backwardly beyond the middle wall 12 and along the bottom wall 14. The insulative housing 1 defines first opening 15 and second opening 16 recessed backwardly from the front wall 11, and a receptacle 18 located behind the openings 15, 16. The first opening 15 and the second opening 16 are aligned in a transverse direction. Each opening 15, 16 is configured to receive a modular plug connector (not shown) therein. The middle wall 12 extends parallel to the front wall 11 and has a plurality of grooves 121 defined thereon to communicate the openings 15, 16 with the receptacle 18. The insulative housing 1 also has a separating or partition wall 17 dividing the first and second openings 15, 16 along a transverse direction. The separating wall 17 extends rearwardly beyond the middle wall 12. The separating wall 17 defines a receiving slot 171 extending therethrough along a front-to-back direction.

The internal modules includes a first internal module 21 corresponding to the first opening 15 and a second internal module 22 corresponding to the second opening 16. The middle shield 3 is disposed between the first and second internal modules 21, 22 for shielding the EMI (electromagnetic interference) therebetween. The middle shield 3 is assembled and retained to the separating wall 17. The middle shield 3 has a front section inserted into the receiving slot 171 and a rear section located behind the separating wall 17. The middle shield 3 divides the receptacle 18 into two module receiving cavities each receiving one internal module 21, 22. Each internal module 21, 22 is inserted from one receiving captivity to one corresponding opening 15, 16.

Figure 4:
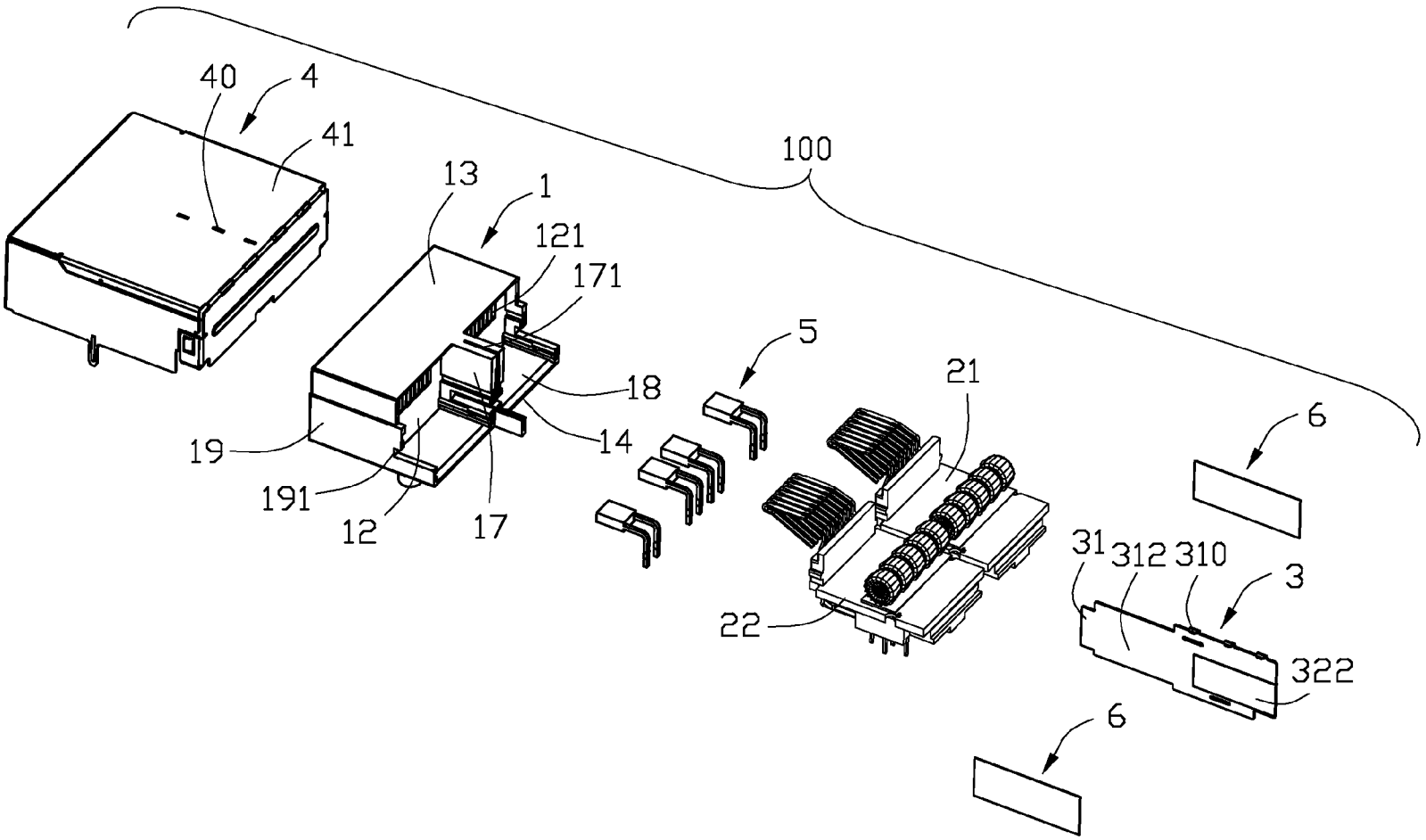
FIG. 4 is a further exploded view of the modular jack shown in FIG. 3.
Figure 5:
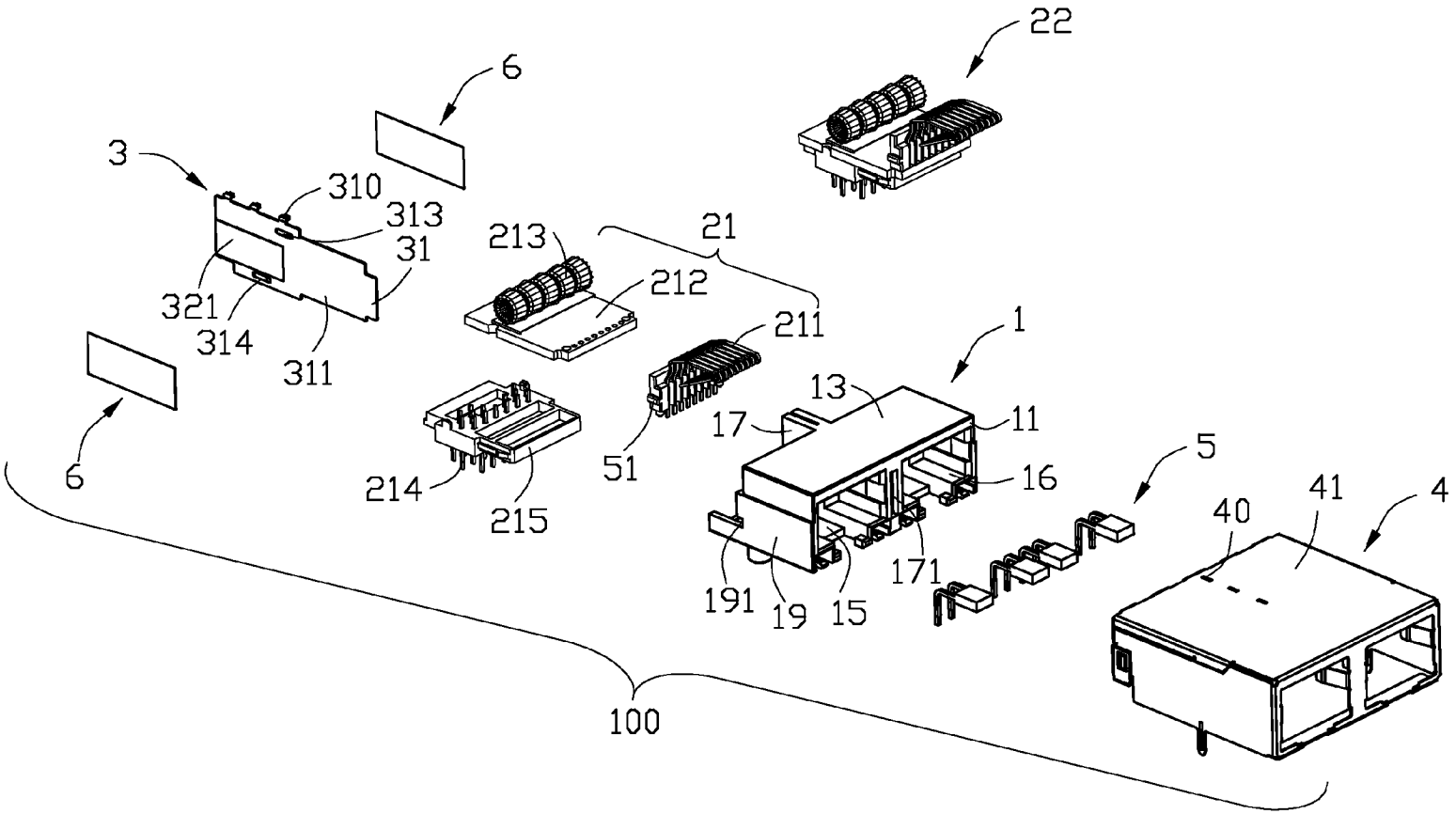
FIG. 5 is a further exploded view of the modular jack shown in FIG. 4.

Referring to FIGS. 4-5, the middle shield 3 has a conductive plate 31 and an insulative sheet 32 affixed thereto. The conductive plate 31 could be a metal plate, and the insulative sheet 32 could be a rubber tape. The insulative sheet 32 faces to the internal module 21, 22 for insulation between the internal module 21, 22 and the conductive plate 31. The conductive plate 31 includes an upper projection 313 and a lower projection 314 to engage with the separating wall 17, and the insulative sheet 32 is disposed between the upper and lower projections 313, 314. The conductive plate 31 has a first surface 311 facing to the first internal module 21 and a second surface 312 facing to the second internal module 22. The insulative sheet 32 includes a first insulative tape 321 pasted to the first surface 311 and a second insulative tape 322 pasted to the second surface 312.

Figure 3:
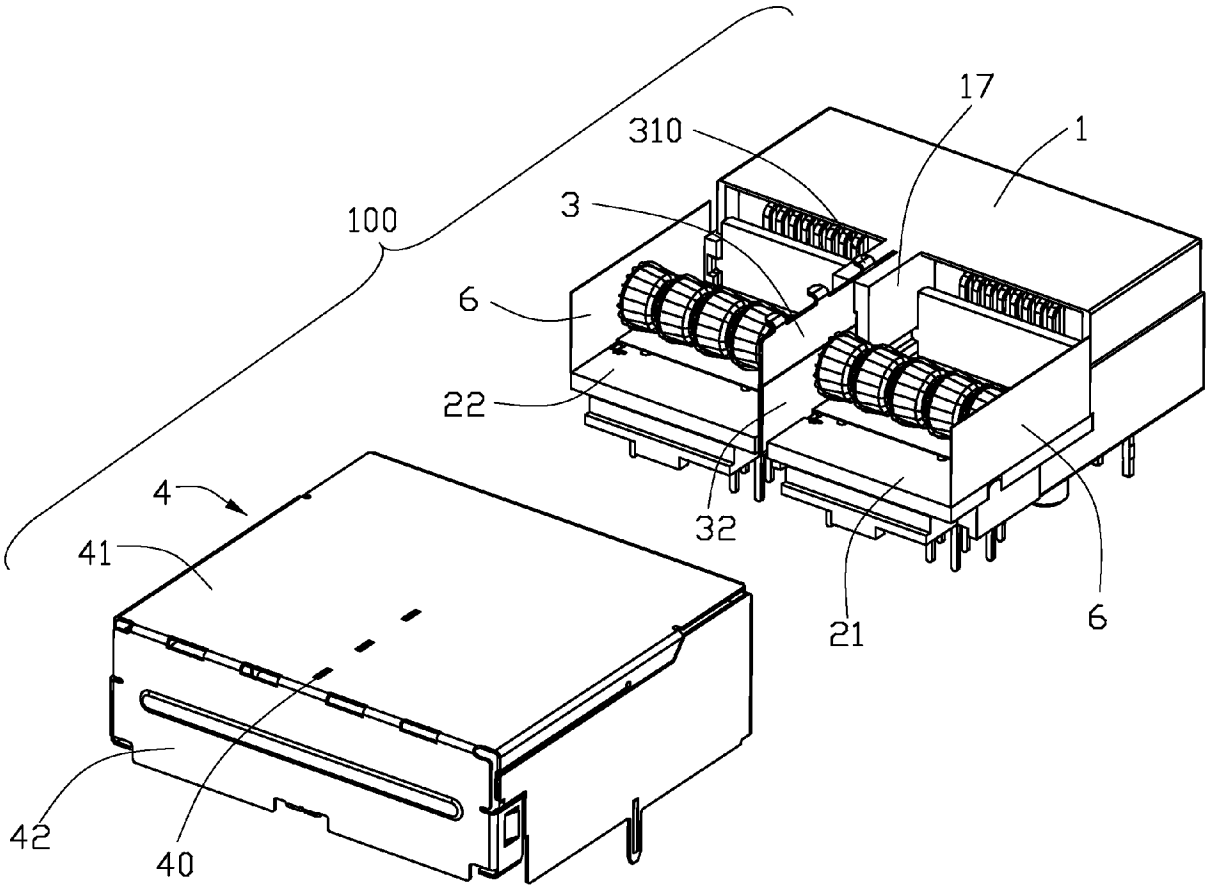
FIG. 3 is an exploded view of the modular jack shown in FIG. 2.

Referring to FIG. 3, the metal shell 4 defines a through-hole 40 extending through a top wall thereof along a top-to-bottom direction. The conductive plate 31 has a top riveted hook 310 inserted across the through-hole 40 and riveted to the metal shell 4.

Figure 6:
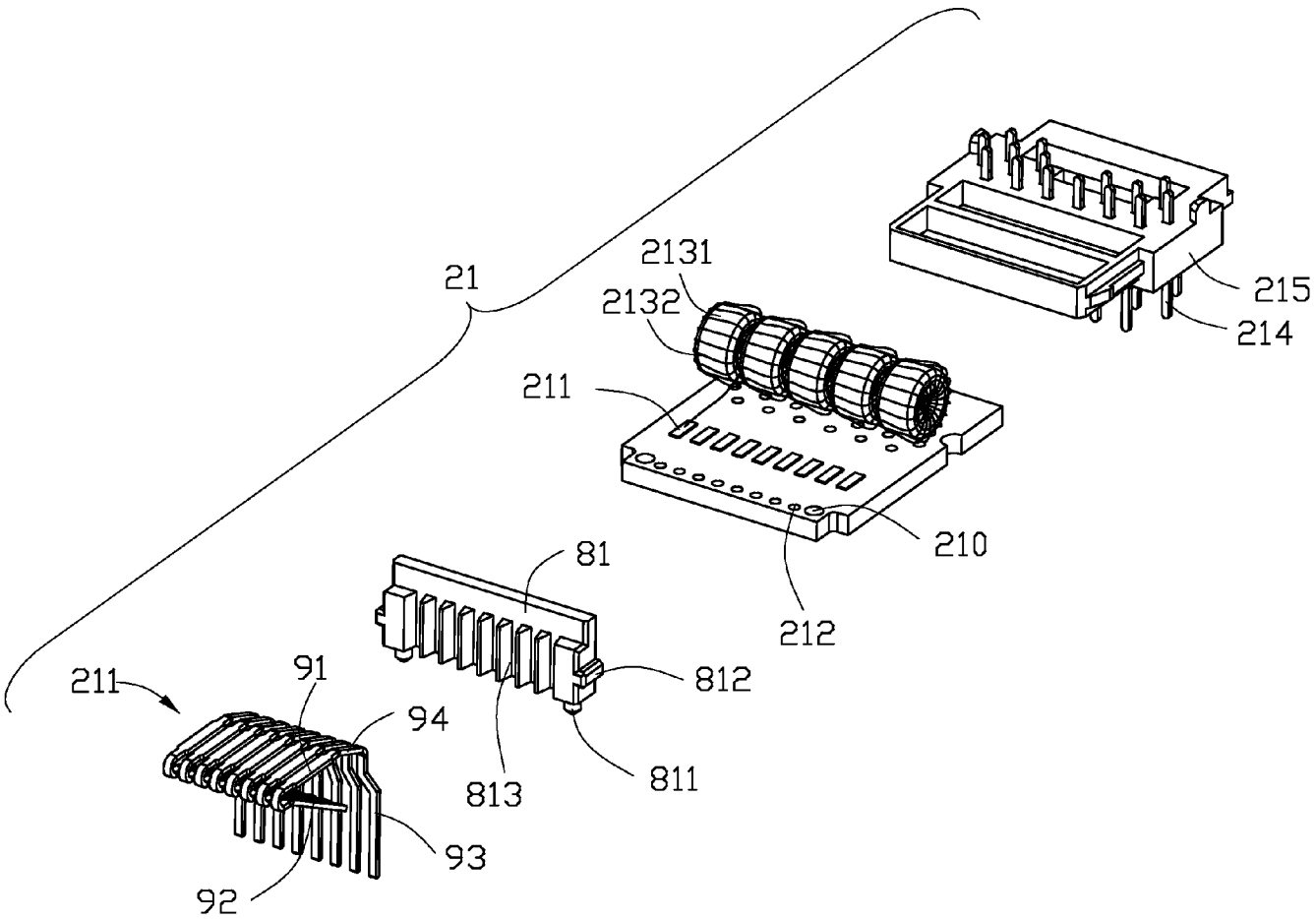
FIG. 6 is an exploded view of an insert module shown in FIG. 4.

Referring to FIGS. 5-6, each of the first internal module 21 and the second internal module 22 has a horizontal PCB (printed circuit board) 212, a set of mating contacts 211 connecting to a front section of the PCB 212, a set of mounting contacts 214 connecting to a rear section of the PCB 212, and a plurality of magnetic components mounted on the PCB 212. The mating contacts 211 electrically connect with the mounting contacts 214 through the PCB 212 and the magnetic components. The magnetic components include a plurality of transformers 213 mounted on a top face of the PCB 212, a plurality of common mode chokes (not shown) mounted on a bottom face of the PCB 212, and a plurality of resistors and capacitors (not shown) mounted on one of the top and bottom faces. Each transformer 213 has a toroid core 2131 and a plurality of conductive wires 2132 winding therearound. The PCB 21 has two rows of conductive pads 211 for connecting ends of the conductive wires 2131, a plurality of conductive through-holes 212 for the mating contacts 211 and mounting contacts 212 to insert therein. The mating contacts 211 are assembled with an insulative body 81 to form a mating contact module, which is mounted onto a top side of the PCB 21. The mounting contacts 214 are insert molded with an insulative carrier 215 to form a mount contact module, which is mounted to a bottom side of the PCB 212.

Figure 7:
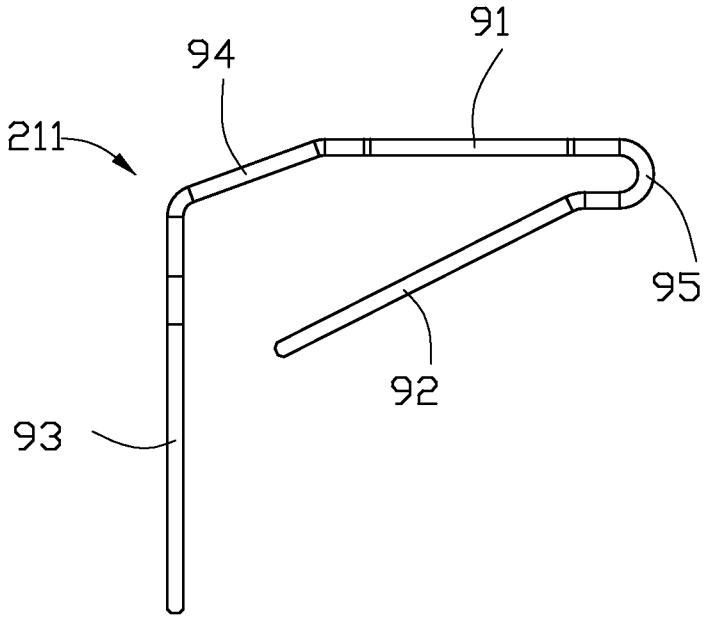
FIG. 7 is a side view of a mating contact shown in FIG. 6.

Referring to FIG. 7, each mating contact 211 has a top horizontal portion 91 inserted into one groove 121, a mating portion 92 extending backwardly and downwardly, a camber portion 95 connected between the mating portion 92 and the horizontal portion 91, a vertical portion 93 assembled to the insulative body 81, and an oblique portion 94 connected between the horizontal portion 91 and the vertical portion 93. The mating portion 92 is exposed within a corresponding opening 15, 16 to mate with a modular plug connector. The oblique portion 94 could decompose the plug insertion force and prevent the mating contact 211 from withdrawing backwardly when the modular plug is inserted into the opening 15, 16. In this embodiment, the vertical portion 93 is retained by and in a spacer 51 so as to reinforce the structural strength thereof.

Referring to FIG. 6, the insulative body 81 includes a positioning post 811 extending downwardly to insert into a positioning hole 210 of the PCB 21, a side projection 812 protruding outwardly to mount within an engaging slot 191 of a side wall 19 of the insulative housing 1, and a plurality of receiving slot 813 extending along the top-to-bottom direction to receive the vertical portions 93 of the mating contacts 211.

Figure 2:
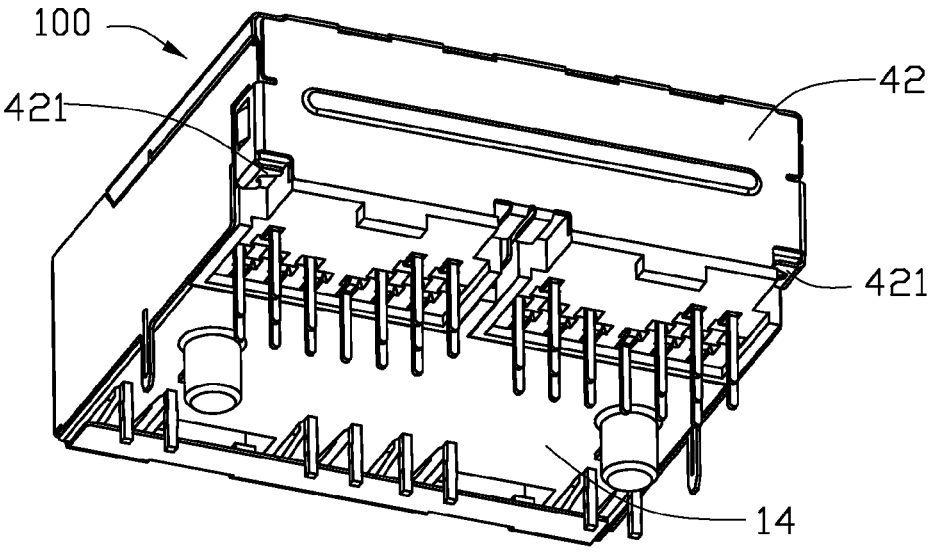
FIG. 2 is another view of the modular jack shown in FIG. 1.

Referring to FIGS. 1-2, the metal shell 4 has a front shell 41 and a rear shell 42 locking thereto. The rear shell 42 has two bottom grounding taps 421 located two opposite sides of the rear shell 42. The PCB 212 has two grounding pads (not labeled) located at a rear bottom face thereof to connect corresponding grounding taps 421.

Referring to FIG. 3, the electrical connector 100 also includes a pair of insulative tape 6 disposed between the internal modules and the side walls of the metal shell 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A modular jack comprising:

an insulative housing having a front wall and a plurality of openings therein configured as pairs of first and second aligned openings neighboring with each other in a lengthwise direction, each opening being configured to receive a plug connector therein in a front-to-back direction perpendicular to said lengthwise direction, and a receptacle located behind the openings; and at least one middle shield located within the receptacle and extending towards the front wall to define a plurality of module receiving cavities; and a plurality of internal modules configured as pairs of first and second aligned internal modules, each internal module located in one corresponding module receiving cavity; wherein the at least one middle shield includes a conductive plate and an insulative sheet affixed to the conductive plate, the insulative sheet facing to the internal module for insulating the internal module from the conductive plate; wherein said insulative housing includes a middle wall extending parallel to the front wall and a plurality of grooves defined thereon to communicate the openings with the receptacle, and said internal module includes a plurality of mating contacts each having a mating section extending into the opening for engaging with a plug connector; wherein said insulative housing includes a separating wall dividing the first and second openings, and said at least one middle shield is assembled and retained to the separating wall; wherein said separating wall has a rear portion extending rearwardly beyond the middle wall in said front-to-back direction and defining a dimension in said vertical direction more than one half of a height of said housing, and defining a slot extending along said front-to-back direction; wherein said conductive plate includes at least one projection bulged in said lengthwise direction and engaged within the slot while said insulative sheet is offset from the projection and disposed outside of the slot.

2. The modular jack as claimed in claim 1, wherein said conductive plate includes an upper projection and a lower projection opposite to each other in a vertical direction perpendicular to both said lengthwise direction and said front-to-back direction to be engaged within the slot of the separating wall, and said insulative sheet is disposed between the upper and lower projections in said vertical direction.

3. The modular jack as claimed in claim 1, wherein each internal module includes a plurality of mounting contacts, a horizontal printed circuit board (PCB) having two opposite sides, one of the two opposite sides connecting with the mating contacts and the other side connecting with the mounting contacts, and a plurality magnetic components mounted on the PCB.

4. The modular jack as claimed in claim 3, wherein said internal module includes an insulative body mounted on the PCB along a top-to-bottom direction, and said mating contacts are assembled and retained to the insulative body.

5. The modular jack as claimed in claim 3, further including a metal shell enclosing the insulative housing, said metal shell having a grounding tap connecting to a grounding pad located at a rear bottom face of the PCB.

6. The modular jack as claimed in claim 1, wherein said conductive plate has a first surface facing to the first internal module and a second surface facing to the second internal module, and said insulative sheet includes a first insulative tape pasted to the first surface and a second insulative tape pasted to the second surface.

7. A modular jack comprising:

an insulative housing including a plurality of units along a lengthwise direction, each unit defining paired front opening and module receiving cavity separated by a middle wall therebetween and aligned with each other in a front-to-back direction perpendicular to said lengthwise direction for receiving a corresponding plug connector and to receive a terminal module;

said terminal module including a printed circuit board with mating contacts connected around a front edge region thereof to extend into the front opening for mating with the plug connector, and with magnetic elements upon the printed circuit board;

the housing including partition walls extending along the front-to-back direction, each of said partition walls located between the two neighboring front openings and between the two neighboring module receiving cavities in said lengthwise direction; and a plurality of metallic middle shields each retained within the corresponding partition wall and extending in the front-to-back direction; wherein each of said middle shields includes a metallic sheet with two opposite surfaces thereof covered by two opposite insulative sheets, respectively, and said middle shield is secured to the corresponding partition wall; wherein each of the partition walls has a rear portion extending rearwardly beyond the middle wall in said front-to-back direction and defining a slot therein, and the corresponding middle shield forms a bulged section protruding away from the middle shield in said lengthwise direction and interferentially engaged within the said slot, and the corresponding said insulative sheets are offset from the bulged section and exposed outside of the slot in said vertical direction.

8. The modular jack as claimed in claim 7, wherein the middle shield is not engaged with the printed circuit board aside.

9. The modular jack as claimed in claim 8, wherein the insulative sheet confront said magnetic elements in said magnetic elements aside in said lengthwise direction.

10. The modular jack as claimed in claim 9, wherein a thickness of said insulative sheet is less than that of the metallic sheet for maximizing a dimension of the module receiving cavity aside in said lengthwise direction.

11. The modular jack as claimed in claim 10, wherein an upper section of the rear portion of the partition wall is terminated in front of magnetic elements in said front-to-back direction so as to maximize the dimension of the modular receiving cavity in the lengthwise direction for allowing the corresponding magnetic element intimately confronting the corresponding middle shield.

12. The modular jack as claimed in claim 7, further including a metallic shell enclosing the housing, wherein said printed circuit board extends horizontally and defines a grounding pad on an undersurface of a rear edge region thereof, and the shell forms a tab soldered upon said grounding pad.

13. The modular jack as claimed in claim 12, wherein the metallic sheet of the middle shield extends through the rear edge region around said grounding pad so as to be commonly soldered with the grounding pad and the tab.

14. A modular jack comprising:

an insulative housing including a plurality of units along a lengthwise direction, each unit defining paired front opening and module receiving cavity aligned with each other in a front-to-back direction perpendicular to said lengthwise direction for receiving a corresponding plug connector and to receive a terminal module;

said terminal module including a printed circuit board with mating contacts connected around a front edge region thereof to extend into the front opening for mating with the plug connector, and with magnetic elements upon the printed circuit board;

the housing including partition walls each located between the two neighboring front openings and between the two neighboring module receiving cavities in said lengthwise direction; and a plurality of metallic middle shields each retained within the corresponding partition wall and extending in the front-to-back direction, each of said middle shields includes a metallic sheet enclosed within an insulative part; further including a metallic shell enclosing the housing, wherein said printed circuit board extends horizontally and defines a grounding pad at a corner of an undersurface of a rear edge region thereof, and the shell forms a horizontal tab soldered upon said grounding pad; wherein said tab is exposed downwardly to an exterior for inspection.

15. The modular jack as claimed in claim 14, further including a spacer to retain the vertical portion of each of said mating contacts.

16. The modular jack as claimed in claim 14, wherein the metallic sheet of the middle shield extends through the rear edge region around said grounding pad so as to be commonly soldered with the grounding pad and the tab.

* * * * *